US011920784B2

(12) United States Patent
Salu et al.

(10) Patent No.: US 11,920,784 B2
(45) Date of Patent: Mar. 5, 2024

(54) TOTAL FLARE GAS RECOVERY SYSTEM

(71) Applicant: Saudi Arabian Oil Company, Dhahran (SA)

(72) Inventors: Samusideen Adewale Salu, Ras Tanura (SA); Mohamed Ahmed Soliman, Ras Tanura (SA); Nisar Ahmad Ansari, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 243 days.

(21) Appl. No.: 17/316,138

(22) Filed: May 10, 2021

(65) Prior Publication Data

US 2022/0357034 A1 Nov. 10, 2022

(51) Int. Cl.
*F23G 7/08* (2006.01)
*F23G 5/50* (2006.01)

(52) U.S. Cl.
CPC ..... *F23G 7/085* (2013.01); *F23G 5/50* (2013.01); *F23G 2207/102* (2013.01); *F23G 2207/20* (2013.01); *F23G 2209/14* (2013.01); *F23G 2900/70601* (2013.01)

(58) Field of Classification Search
None
See application file for complete search history.

(56) References Cited

U.S. PATENT DOCUMENTS 4,223,803 A 9/1980 Pearson
5,176,164 A 1/1993 Boyle
5,209,301 A 5/1993 Ayres
5,343,941 A 9/1994 Raybon
5,810,578 A * 9/1998 Hystad ..... E21B 41/0071 431/202
6,461,695 B1 * 10/2002 Schaap ..... B29C 70/222 428/34.1

(Continued)

FOREIGN PATENT DOCUMENTS

CN 107917337 A * 4/2018 ..... F17C 1/00
CN 112705016 A 4/2021

(Continued)

OTHER PUBLICATIONS

English translation of Jiang.*

(Continued)

*Primary Examiner* — Jason Lau
(74) *Attorney, Agent, or Firm* — Bracewell LLP; Constance G. Rhebergen; Keith R. Derrington

(57) ABSTRACT

Flare gas is recovered by varying a number of ejector legs that depends on a flare gas flowrate. The ejector legs include ejectors piped in parallel, each ejector has a flare gas inlet and a motive fluid inlet. Flare gas and motive fluid is provided to ejectors by selectively opening or closing valves. The number of ejector legs online is varied to accommodate the amount of flare gas. The controller is also programmed to direct signals to actuators attached to the valves to open or close the valves, or to change the capacity of the ejector legs so they can handle changing flowrates of the flare gas. Included is a flare gas storage system with vessels made with flexible material, when flare gas is evacuated from the vessels, pressure in the vessels is maintained by compressing the vessels with an external force.

10 Claims, 4 Drawing Sheets

(56) References Cited

U.S. PATENT DOCUMENTS

| | | | |
|---|---|---|---|
| 6,767,877 | B2 | 7/2004 | Kuo et al. |
| 6,779,548 | B2 | 8/2004 | McKeary |
| 7,066,353 | B2 | 6/2006 | Hammonds |
| 8,584,691 | B2 | 11/2013 | Hammonds |
| 8,992,838 | B1 | 3/2015 | Mueller |
| 9,033,178 | B2 | 5/2015 | White |
| 9,109,512 | B2 | 8/2015 | Ingersoll et al. |
| 9,714,739 | B2 | 7/2017 | Killeen et al. |
| 2004/0084081 | A1 | 5/2004 | Liu et al. |
| 2012/0315587 | A1 | 12/2012 | Gross-Petersen |
| 2016/0009488 | A1 | 1/2016 | Hudala et al. |
| 2016/0238194 | A1 | 8/2016 | Adler et al. |
| 2018/0149357 | A1 | 5/2018 | Salu et al. |

FOREIGN PATENT DOCUMENTS

| | | | | | |
|---|---|---|---|---|---|
| EP | 0749058 | A2 | | 12/1996 | |
| GB | 2477586 | A | * | 8/2011 | ..... F02B 21/02 |
| JP | 2006234095 | A | | 9/2006 | |

OTHER PUBLICATIONS

SA 1st Examination Report, Application No. 122431036 dated Dec. 14, 2022.

Forbes Marshall Steam Operated Condensate Pump, found at www.forbesmarshall.com/fm_micro/Products5.aspx?

Google English translation of JP2006234095A, Publication date of Sep. 7, 2006, 4 pages.

International Search Report and Written Opinion dated May 24, 2018 of related application PCT/US2018/012907.

M. Daas, Downhole Chemical Injection Through Gas Lift: Options and Consequences, Jun. 14-17, 2011.

Spirax Sarco Ogden Automatic Pump Instruction Manual, IM-P015-12 ST Issue 3, 1998.

TLV Power Trap, found at www.tlv.com/global/US/product-operation/powertrap-gp10.html.

* cited by examiner

TOTAL FLARE GAS RECOVERY SYSTEM

BACKGROUND

1. Field

The present disclosure relates to a system and method for handling fluid directed to a flare system. More specifically, the present disclosure relates to a system and method for recovering and storing flare gas.

2. Related Art

Flare disposal system are typically provided in facilities that handle or process volatile compounds, such as refineries and chemical plants. Flare disposal systems collect releases of compounds being handled in the facility, and channel the released compounds ("flare gas") through flare network piping. Flare disposal systems generally include flare headers, flare laterals, liquid knock-out drums, water seal drums, and one or more flare stacks. Flare headers are normally provided with continuous purging to prevent vacuums within the system, keep air out of the system, and prevent possible explosions. Usually the flare network piping delivers the compounds to the flare stack for combusting the compounds. During normal operations in the processing facility, the amount of flare gas collected ("normal flare gas flow") is primarily from gas used to purge the flare headers as well as gas leakage across isolation valves.

Excursions from normal operations in the facility (such as overpressure, automatic depressurizing during a fire, manual depressurizing during maintenance, the tripping of a compressor, off-spec gas products, downstream gas customer shut down, or extended field testing) generate an emergency flare gas flow, which has a flowrate that exceeds the normal flare gas flow. Some processing facilities include flare gas recovery systems, for diverting the normal gas flow back to the process facility, where the flare gas is sometimes pressurized and compressed so that it can be injected back into a process line, or to another destination through a pipeline. The gas is typically compressed by liquid-ring compressors, screw-type compressors, and blowers. Substantially all of the gas from a normal flare gas flow can be handled by most conventional flare gas recovery systems, thereby limiting flare operation to the excursions listed previously.

SUMMARY

Disclosed herein is an example of a processing facility having a source of flare gas, a flare gas recovery system, and a flare gas storage system made up of flare gas storage units that each have an outer shell made from a flexible material that is supported on a resilient member to define a vessel. The flare gas storage units can each further include a pressure system that is selectively changeable between an extended configuration and a retracted configuration, and when in the extended configuration the vessel is in a compressed configuration. Optionally, the pressure system includes an arm, a platen mounted on an end of the arm and that is in contact with an end of the vessel, and an actuator that when selectively energized the arm and platen are urged into compressive engagement with the vessel and the vessel and resilient member are reconfigured into a compressed configuration. The resilient member can be a helical spring. In an example, the flexible material defines a barrier to flare gas and forms a cavity in which flare gas is stored. Optionally included is a pressure sensor in pressure communication with an inside of the vessel and that is in communication with the pressure system; in an alternative the pressure system is controlled based on pressure sensed inside the vessel. The flare gas storage units can be arranged in parallel, the flare gas storage system in this example further includes a piping circuit, wherein the flare gas storage units are in selective communication with the source of flare gas through the piping circuit. In an embodiment, the piping circuit includes a fluid line, fluid leads, and valves in the lines and leads, and wherein the valves are selectively opened and closes to provide communication to the flare gas storage units. The flare gas recovery system in an example includes a piping circuit having legs of tubulars piped in parallel that are selectively online, an ejector in each of the legs and where a one of the ejectors has a design flowrate that is approximately equal to an anticipated minimum flowrate of the flare gas, each ejector having, a low pressure inlet in selective communication with a source of the flare gas, a high pressure inlet in selective communication with a source of motive fluid, and a mixing portion where flare gas and motive fluid form a combination and a controller system for bringing a quantity of the legs online that have a cumulative capacity that is at least as great as a measured flowrate of the flare gas.

Also disclosed is a method of operating a processing facility by receiving an amount of flare gas from a flare gas source, using a flare gas recovery system to direct the flare gas to a vessel in a flare gas storage system, storing the flare gas in the vessel, and compressing the vessel to remove the flare gas from the vessel. The step of compressing the vessel is optionally controlled based on pressure inside the vessel. In an alternative, the step of compressing the vessel involves applying an axial force to an end of the vessel, the method further includes removing the axial force and allowing the vessel to automatically change from a compressed configuration to an extended configuration. The method optionally further includes directing another amount of flare gas into the vessel. In an alternative, the vessel is a first vessel, the method further involving storing the flare gas in multiple vessels, and wherein the vessels are piped in parallel. The method can further include selectively directing flare gas to less than all of the vessels by maintaining valves in a closed configuration, wherein the valves are in a piping circuit that provides fluid communication to the vessels from the source of the flare gas.

BRIEF DESCRIPTION OF DRAWINGS

Some of the features and benefits of that in the present disclosure having been stated, others will become apparent as the description proceeds when taken in conjunction with the accompanying drawings, in which.

Figure 1:
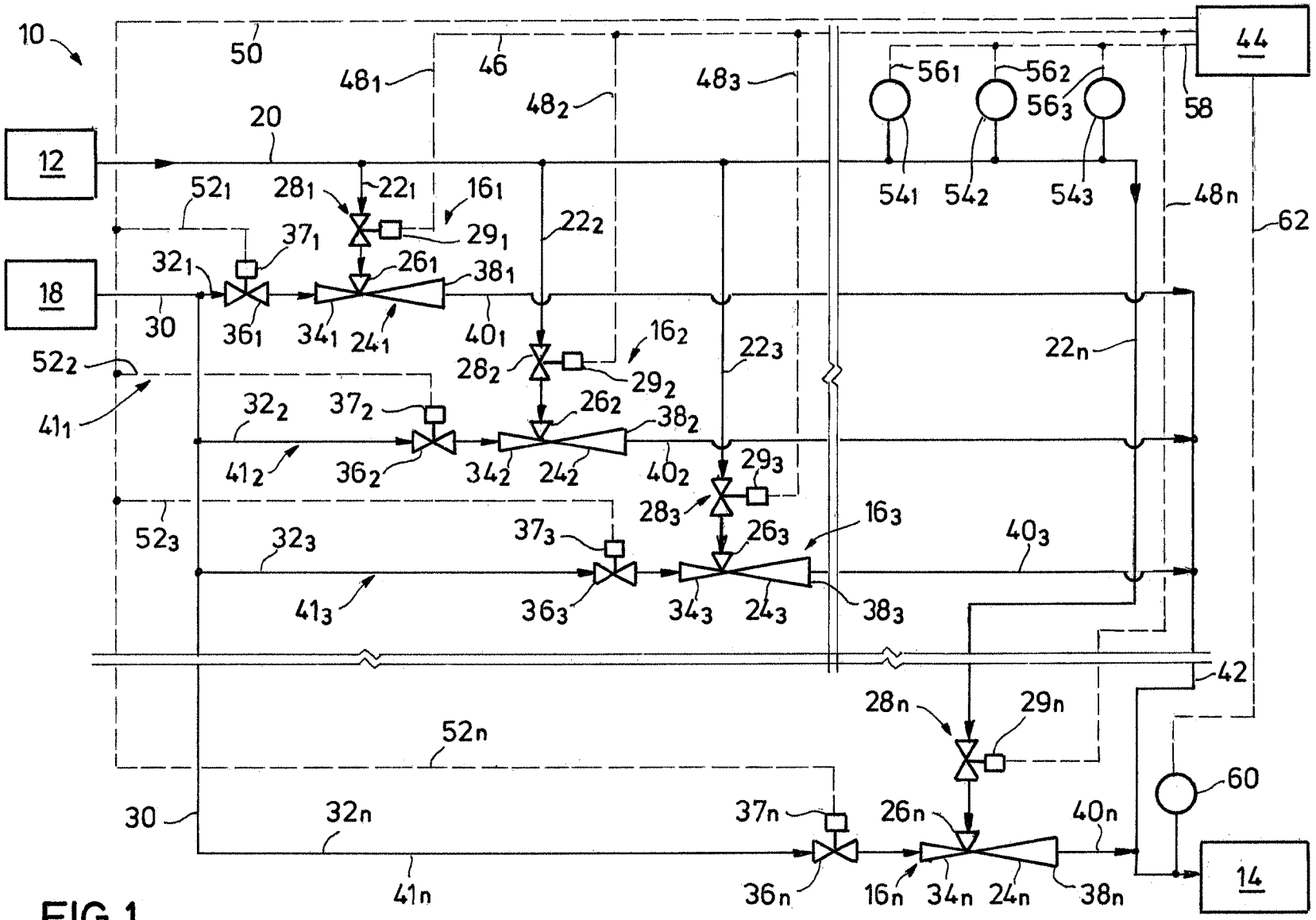
FIG. 1 is a schematic of an example of a total flare gas recovery system having a transient multiple legs liquid ejector and for use with a processing facility.

While that disclosed will be described in connection with the preferred embodiments, it will be understood that it is not intended to limit that embodiments. On the contrary, it is intended to cover all alternatives, modifications, and equivalents, as may be included within the spirit and scope of that described.

DETAILED DESCRIPTION

The method and system of the present disclosure will now be described more fully after with reference to the accompanying drawings in which embodiments are shown. The method and system of the present disclosure may be in many different forms and should not be construed as limited to the illustrated embodiments set forth; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Schematically illustrated in FIG. 1 is one example of a total flare gas recovery system ("TFGRS") 10 that receives flare gas from a flare gas supply 12 and pressurizes the flare gas for return back to a processing facility 14. In an embodiment the processing facility 14 includes a unit, system, or manufacturing installation where volatile materials are being handled, non-limiting examples include a refinery, a factory, a chemical plant, and combinations. Also depicted in the example of FIG. 1 are "n" ejector systems $\mathbf{16}_1$, $\mathbf{16}_2$, $\mathbf{16}_3$ . . . $\mathbf{16}_n$, which in an alternative is represented as $\mathbf{16}_{1\text{-}n}$, and where n can be any integer. In the example, ejector systems $\mathbf{16}_{1\text{-}n}$ receive the flare gas from the flare gas supply 12; and a motive fluid from a motive fluid source 18 is also directed to the ejector systems $\mathbf{16}_{1\text{-}n}$, which in an example provides a motive force for directing the flare gas to the processing facility 14. Examples of the motive fluid include liquid, gas, and combinations. Embodiments exist where the combination of flare gas and motive fluid are utilized in the processing facility 14, such as for a reactant, an additive, a fuel source, or inserted into a flow line (not shown) having the same or similar components as the combination. A schematic example of a flare gas header 20 is shown having one end in communication with the flare gas supply 12. In the example flare gas inlet leads $\mathbf{22}_{1\text{-}n}$ extend from the flare gas header 20 and connect to ejectors $\mathbf{24}_{1\text{-}n}$. In the illustrated embodiment, flare gas inlets $\mathbf{26}_{1\text{-}n}$ are provided respectively on ejectors $\mathbf{24}_{1\text{-}n}$, and provide a connection point for the ends of the flare gas inlet leads $\mathbf{22}_{1\text{-}n}$. Further in the example of FIG. 1, flare gas inlet valves $\mathbf{28}_{1\text{-}n}$ are disposed respectively on the flare gas inlet leads $\mathbf{22}_{1\text{-}n}$, and which when opened and closed selectively block or allow flare gas flow to designated ones of the ejectors $\mathbf{24}_{1\text{-}n}$. Optional actuators $\mathbf{29}_{1\text{-}n}$ are shown coupled with valves $\mathbf{28}_{1\text{-}n}$, and when energized selectively open and/or close valves $\mathbf{28}_{1\text{-}n}$.

A motive fluid header 30 is shown included with the system 10 of FIG. 1 and that as illustrated has an end connected to the motive fluid source 18, and through which fluid communication is provided between the motive fluid source 18 and motive fluid inlet leads $\mathbf{32}_{1\text{-}n}$. Motive fluid inlet leads $\mathbf{32}_{1\text{-}n}$ are shown extending from points along the motive fluid header 30 and into connection with motive fluid inlets $\mathbf{34}_{1\text{-}n}$ provided on ends of the ejectors $\mathbf{24}_{1\text{-}n}$. Included in the embodiment shown are motive fluid inlet valves $\mathbf{36}_{1\text{-}n}$ that are set in line within the motive fluid inlet leads $\mathbf{32}_{1\text{-}n}$, and like the flare gas inlet valves $\mathbf{28}_{1\text{-}n}$, the motive fluid inlet valves $\mathbf{36}_{1\text{-}n}$ are opened and closed to selectively block flow of motive fluid to ones of the ejectors $\mathbf{24}_{1\text{-}n}$. Actuators $\mathbf{37}_{1\text{-}n}$ are included in this embodiment that mount to motive fluid inlet valves $\mathbf{36}_{1\text{-}n}$, for opening and closing these valves $\mathbf{36}_{1\text{-}n}$.

In a non-limiting example of operation, when one or more of valves $\mathbf{36}_{1\text{-}n}$ is in an open configuration, motive fluid enters the ejectors $\mathbf{24}_{1\text{-}n}$ via motive fluid inlets $\mathbf{34}_{1\text{-}n}$ and subsequently flows through reduced cross-sectional areas within ejectors $\mathbf{24}_{1\text{-}n}$ where velocities of the motive fluid increase and its pressures reduce. Examples of valves $\mathbf{36}_{1\text{-}n}$ being in an open configuration include a valve member (not shown) within the particular valve $\mathbf{36}_{1\text{-}n}$ or valves $\mathbf{36}_{1\text{-}n}$ moved fully or partially from within a passage (not shown) through the valve $\mathbf{36}_{1\text{-}n}$ or valves $\mathbf{36}_{1\text{-}n}$. In one embodiment, the ejectors $\mathbf{24}_{1\text{-}n}$ are strategically configured so that the pressures of the motive fluid reduce within the reduced cross-sectional areas of ejectors $\mathbf{24}_{1\text{-}n}$ to below that of the flare gas at the flare gas inlets $\mathbf{26}_{1\text{-}n}$. Further in this embodiment, pressure differentials between the motive fluid in the reduced cross-sectional areas of ejectors $\mathbf{24}_{1\text{-}n}$ and the flare gas at the flare gas inlets $\mathbf{26}_{1\text{-}n}$ draw the flare gas into gas ejectors $\mathbf{24}_{1\text{-}n}$ where the flare gas is combined with the motive fluid. In this example, the cross-sectional areas of the flow paths within ejectors $\mathbf{24}_{1\text{-}n}$ (in which the combined flare gas and motive fluid are flowing) increase downstream of the reduced cross-sectional areas with distance away from the motive fluid inlets $\mathbf{34}_{1\text{-}n}$, and which define ejector venturi exits $\mathbf{38}_{1\text{-}n}$. Inside the ejector venturi exits $\mathbf{38}_{1\text{-}n}$, velocities of the combinations of the motive and flare gas decrease, and pressures of the combinations increase. In the illustrated example, the motive fluid and flare gas are mixed in the ejector venturi exits $\mathbf{38}_{1\text{-}n}$. In this example, discharge ends of the ejector venturi exits $\mathbf{38}_{1\text{-}n}$ are in fluid communication with discharge gas leads $\mathbf{40}_{1\text{-}n}$, so that the mixed fluid or fluids flowing from the ejector venturi exits $\mathbf{38}_{1\text{-}n}$ are directed to the discharge gas leads $\mathbf{40}_{1\text{-}n}$.

Still referring to the example of FIG. 1, the combination of the leads $\mathbf{32}_{1\text{-}n}$, $\mathbf{40}_{1\text{-}n}$, valves $\mathbf{36}_{1\text{-}n}$, $\mathbf{28}_{1\text{-}n}$, and ejectors $\mathbf{24}_{1\text{-}n}$ define a series of ejector legs $\mathbf{41}_{1\text{-}n}$, which are shown piped in parallel. In a non-limiting example of operation, flare gas from the flare gas supply 12 and/or motive fluid from the motive fluid supply 18 are transmitted through specific ones of the legs $\mathbf{41}_{1\text{-}n}$ (i.e. brought online) by selectively opening/closing specific ones of the valves $\mathbf{36}_{1\text{-}n}$, $\mathbf{28}_{1\text{-}n}$. In the illustrated embodiment, motive fluid passing through a particular one of the valves $\mathbf{36}_{1\text{-}n}$ flows inside a particular leg $\mathbf{41}_{1\text{-}n}$ associated with the particular one of the valves $\mathbf{36}_{1\text{-}n}$ and other components within that leg $\mathbf{41}_{1\text{-}n}$, e.g. opening valve $\mathbf{36}_1$ provides flow into leg $\mathbf{41}_1$, ejector $\mathbf{24}_1$, ejector exit $\mathbf{38}_1$, discharge gas leads $\mathbf{40}_1$, and so on. In an alternative, energizing actuators $\mathbf{29}_{1\text{-}n}$ and actuators $\mathbf{37}_{1\text{-}n}$ respectively opens/closes valves $\mathbf{28}_{1\text{-}n}$, $\mathbf{36}_{1\text{-}n}$, and where actuators $\mathbf{29}_{1\text{-}n}$ and actuators $\mathbf{37}_{1\text{-}n}$ receive power from a power source (not shown) that is converted into a mechanical force for opening/closing valves $\mathbf{28}_{1\text{-}n}$, $\mathbf{36}_{1\text{-}n}$; examples of power include electricity, pneumatic, and mechanical. In the illustrated example, the discharge gas leads $\mathbf{40}_{1\text{-}n}$ distal from ejectors $\mathbf{24}_{1\text{-}n}$ terminate in a discharge gas header 42, which is depicted connected to processing facility 14. An example piping circuit 43 is defined by ejector legs $\mathbf{41}_{1\text{-}n}$, flare gas header 20, and discharge gas header 42. As illustrated, the combination of flare and motive fluid exiting the discharge gas lead or leads $\mathbf{40}_{1\text{-}n}$ is transmitted to the processing facility 14 via the discharge gas header 42.

Further included in the example of FIG. 1 is a controller 44 shown in communication with the actuators $\mathbf{29}_{1\text{-}n}$ across a flare gas signal bus 46 and flare gas signal leads $\mathbf{48}_{1\text{-}n}$ having ends distal from the flare gas signal bus 46 that connect to the actuators $\mathbf{29}_{1\text{-}n}$. Also shown in this embodiment is a motive fluid signal bus 50 connected to controller 44, and motive fluid signal leads $\mathbf{52}_{1\text{-}n}$ extending from motive fluid signal bus 50 respectively to actuators $\mathbf{37}_{1\text{-}n}$. In an example, a designated flare gas leg or legs $\mathbf{41}_{1\text{-}n}$ is/are put online when a signal from controller 44 is directed to one or more of actuators $\mathbf{29}_{1\text{-}n}$, $\mathbf{37}_{1\text{-}n}$ via flare gas signal bus 46 and one or more flare gas signal leads $\mathbf{48}_{1\text{-}n}$, $\mathbf{52}_{1\text{-}n}$. In response to the received signals actuators $\mathbf{29}_{1\text{-}n}$, $\mathbf{37}_{1\text{-}n}$ open one or more of valves $\mathbf{28}_{1\text{-}n}$, $\mathbf{36}_{1\text{-}n}$ so that flare gas and motive fluid flow to one or more of the ejectors $\mathbf{24}_{1\text{-}n}$. In a contrasting example, a designated flare gas leg or legs $\mathbf{41}_{1\text{-}n}$ is taken offline by controller 44 directing a signal(s) to actuators $\mathbf{29}_{1\text{-}n}$, $\mathbf{37}_{1\text{-}n}$, that in turn closes one or more of valves $\mathbf{28}_{1\text{-}n}$, $\mathbf{36}_{1\text{-}n}$ so that a flow of flare gas and motive fluid is blocked to one or more of the ejectors $\mathbf{24}_{1\text{-}n}$. In the example of FIG. 1, a leg or legs $\mathbf{41}_{1\text{-}n}$ is online when a combination of motive fluid and flare gas is flowing within, and offline when one or both of motive fluid or flare gas is isolated from the leg or legs $\mathbf{41}_{1\text{-}n}$.

Optional flare gas indicators $\mathbf{54}_{1\text{-}3}$ are mounted on the flare gas header 20, and which selectively sense fluid flowrate, pressure, temperature, or other fluid properties or conditions within flare gas header 20. In an example, the data sensed by the flare gas indicators $\mathbf{54}_{1\text{-}3}$ is transmitted to controller 44 via flare gas indicator signal leads $\mathbf{56}_{1\text{-}3}$ and flare gas indicator signal line 58, which is shown as connecting the leads $\mathbf{56}_{1\text{-}3}$ to controller 44. A discharge gas indicator 60 is illustrated mounted onto discharge gas header 42 and also provides fluid property and condition information within header 42 and which is transmitted to controller 44 along discharge gas indicator signal line 62. In one example, controller 44 includes or is made up of an information handling system ("IHS"), where the IHS includes a processor, memory accessible by the processor, nonvolatile storage area accessible by the processor, and logics for performing steps described herein. An example trend of flare gas flowrate over time is provided in Salu et al., U.S. Pat. No. 10,429,067 ("Salu et al, '067"), and which is incorporated by reference herein in its entirety for all purposes. Salu et al '067 and the present application have a common assignee.

Figure 2:
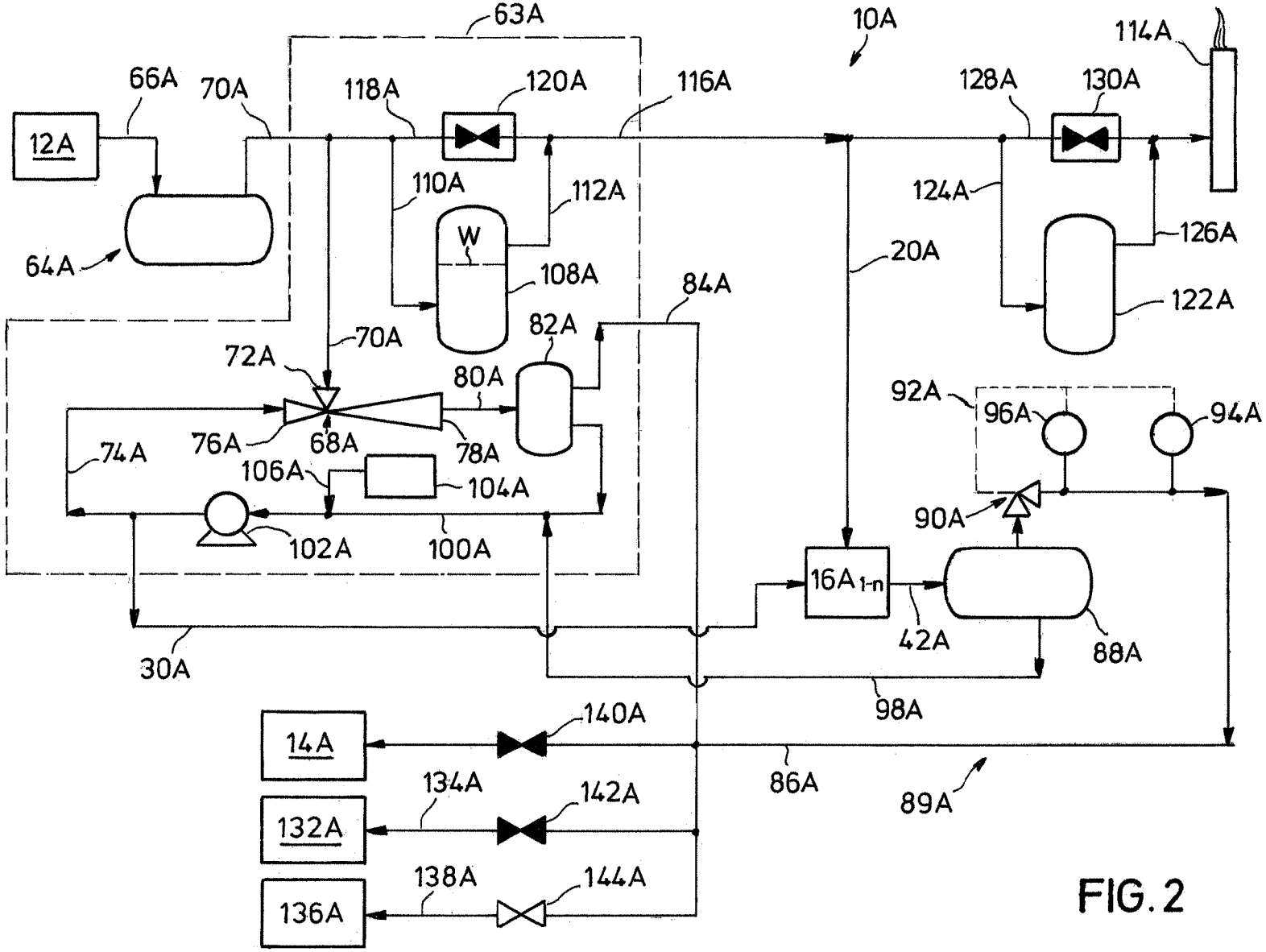
FIG. 2 is a schematic of an alternate example of a total flare gas recovery system.

Shown in schematic form in FIG. 2 is an alternate example of the TFGRS 10A, and which is combined with a conventional flare gas recovery system 63A. The embodiment of the conventional flare gas system 63A shown includes a knockout drum 64A, and knockout inlet line 66A that provides fluid communication between flare gas supply 12A and knockout drum 64A. Further in the example, an ejector 68A is shown downstream of knockout drum 64A, and a line 70A directs gas from knockout drum 64A to a flare gas inlet 72A. Here flare gas inlet 72A is attached to ejector 68A, so that flare gas is fed to ejector 68A via line 70A and flare gas inlet 72A. Motive fluid is delivered to ejector 68A via motive fluid line 74A. An end of motive fluid line 74A distal from motive fluid header 30A connects to motive fluid inlet 76A of ejector 68A. In the illustrated example opposing ends of the motive fluid header 30A connect respectively to the motive fluid inlet 76A and the ejector system $\mathbf{16}\mathrm{A}_{1\text{-}n}$ and provide communication of motive fluid to ejector system $\mathbf{16}\mathrm{A}_{1\text{-}n}$. Motive fluid and flare gas are combined within ejector 68A, and as previously explained, pressure of the combined fluids increases through the expanded cross-sectional area of the ejector venturi 78A while the velocity decreases.

Further in the example of FIG. 2, after exiting ejector venturi 78A the combined fluids are piped into a discharge gas lead 80A in which the fluids are carried to separator tank 82A. Inside tank 82A flare gas is separated from the combined fluids and flows into separator gas line 84A at a pressure greater than pressure in line 70A. Line 84A terminates in recovery system gas line 86A, which initiates from TFGRS separator tank 88A. In one example, recovery system gas line 86A and TFGRS separator tank 88A define a flare gas discharge 89A. As shown in the example of FIG. 2, an end of line 42A connects to TFGRS separator tank 88A so that combined fluid flowing in line 42A flows into TFGRS separator tank 88A. Inside TFGRS separator tank 88A the combined fluid stratifies due to gravity to separate gas and motive fluid. In this example gas migrates towards an upper portion of TFGRS separator tank 88A and enters line 86A shown attached to an upper surface of TFGRS separator tank 88A. Depicted in line 86A is a control valve 90A for selectively controlling the flow of gas through line 86A. In one example control valve 90A is a pressure control valve that opens when pressure within the separator tank 88A is at or exceeds a designated value; the control valve 90A in this example permits a flow of gas through line 86A when gas is at a pressure sufficient to be reinjected back into the process facility 14A. In an example, TFGRS separator tank 88A and control valve 90A provide a way of delivering flare gas to the processing facility 14A at a consistent pressure. A flare gas feedback circuit 92A is schematically shown in FIG. 2 coupled with line 86A that includes sensors 94A, 96A, which in an example sense conditions inside line (such as temperature, flow, and pressure) and provides signals representing data obtained by sensors 94A, 96A. The signals are optionally transmitted to control valve 90A, controller 44 (FIG. 1), or other control systems (not shown) for controlling and/or optimizing operation of system 10, 10A. In an alternative, a logic circuit (not shown) receives the signal data from circuit 92A and operates per a rule based system to selectively open and close control valve 90A. Also shown connected to TFGRS separator tank 88A is separated liquid return line 98A, which in the example shown mounts onto a lower portion of TFGRS separator tank 88A and selectively carries liquid separated from the combined fluid inside tank 88A to a separated liquid recycle line 100A. The separated liquid recycle line 100A of FIG. 2 transfers liquid from separator tank 82A to a suction side of a pump 102A; which is shown in the example as a centrifugal pump, but alternatives exist where pump 102A is a positive displacement type pump. An optional source of makeup liquid 104A selectively provides liquid to separator liquid recycle line 100A via makeup liquid line 106A. In this example, the motive fluid is liquid water and is used with the transient legs of the ejector system $\mathbf{16}\mathrm{A}_{1\text{-}n}$ of FIG. 1.

Still referring to the example of FIG. 2, water seal drum 108A is shown having a volume of water W disposed within and in communication with flare gas in overhead line 70A via a seal drum inlet 110A. In instances where an amount of flare gas flowing within overhead line 70A exceeds the operating capacity of ejector 68A, the amount of flare gas exceeding the ejector 68A capacity is redirected into water seal drum 108A via seal drum inlet 110A. When the pressure of the flare gas within seal drum inlet 110A exceeds the static head of the water W above where inlet 110A connects to water seal drum 108A, the flare gas breaks the water seal and flows out of the water seal drum 108A via seal drum outlet 112A. As described in more detail below, a flare 114A is shown for optionally combusting the flare gas. In the illustrated embodiment, flare gas exiting seal drum outlet 112A is directed into flare header 116A. An optional bypass 118A is shown connected between lines 70A, 116A and circumventing water seal drum 108A. In a non-limiting example of use, the bypass 118A provides for an alternate route of gas flow should the water seal in the drum 108A block a flow of flare gas through seal drum 108A at conditions or situations when flare gas is designed to flow through the seal drum 108A, i.e. fail to break. A block valve 120A is shown disposed in bypass 118A, and which is selectively opened and closed to allow flow through bypass 118A and between lines 70A, 116A. In one alternative, a rupture pin or bursting disc (not shown) is used in place of block valve 120A.

A water seal drum 122A is illustrated in this example of FIG. 2 and disposed downstream of water seal drum 108A, water seal drum 122A is shown in fluid communication with flare header 116A via seal drum inlet line 124A. Similar to water seal drum 108A an amount of water (not shown) in water seal drum 122A forms a low pressure barrier blocking flare gas within header 116A from reaching flare stack 114A until pressure of flare gas exceeds that of the low pressure barrier. After the seal within seal drum 122A is broken the flare gas makes its way to flare stack 114A via seal drum outlet line 126A. An optional bypass 128A is provided with this example and which includes a block valve 130A that when selectively opened provides a bypass around water seal drum 122A. Optionally, a rupture pin or bursting disc is used in place of the block valve 130A. Upon reaching the flare stack 114A, flare gas is combusted and with its combustion products being distributed into the atmosphere from flare stack 114A. Flare gas header 20A connects to flare header 116A upstream of seal drum inlet line 124A and provides flare gas to ejector system 16$A_{1-n}$.

In the example of the TFGRS 10A shown in FIG. 2, flare gas is alternatively transmitted to facility 14A through line 86A, to a pipeline 132A with line 134A, or gas storage system 136A via line 138A. In examples, one or both of gas storage system 136A and TFGRS 10A are included in facility 14A; and in alternatives, one or both of gas storage system 136A and TFGRS 10A are separate from facility 14A. Valves 140A, 142A, 144A are shown respectively disposed in lines 86A, 134A, 138A for controlling the flow of flare gas through these lines 86A, 134A, 138A and to one or more of facility 14A, pipeline 132A, and gas storage system 136A. In the example shown, valves 140A, 142A are depicted in a closed configuration, and valve 144A is in an open configuration; so that flare gas flowing in lines 84A, 86A is directed to gas storage system 136A.

Example scenarios of flare gas releases to a flare system include pressure safety relieving, automatic blow-down (depressurizing), manual depressurization (such as venting during maintenance). Transient flow-rates associated with a pressure safety relieving scenario occur in examples when equipment or piping systems are over pressured and reach a relief valve or rupture disc set point that was installed to protect equipment or piping. Flowrates for a scenario are optionally considered to be continuous when relieving due to a blocked discharge. In an example a pressure safety relieving instance has a limited duration of time of about maximum 10-15 minutes as the relieving rate ceases once the source of overpressure is isolated or eliminated. Automatic blow-down (depressurizing) optionally occurs due to process plant safety requirements. In one alternative, each pressurized system is protected from rupturing due to fire by providing automatic isolation valves at key system boundaries and a blow-down valve for each system/segment of the entire plant based on the fire isolation philosophy of the plant. In an example of responding to a fire in a particular segment of the processing facility 14, the isolation valves (not shown) automatically close while the blow-down valve (not shown) automatically opens and each system is depressurized to a specific limit within a given time. API RP 521 ($6^{th}$ edition, 2014) recommends depressurizing to 6.9 bar gauge or 50% of (vessel) design pressure, whichever is the lower, within 15 minutes. This is achievable by using a control valve or alternatively by using a combination of automated isolation valve (blow-down valve) with fixed orifice downstream. In one embodiment, the blow-down valve opens fully automatically on demand. Compressors are optionally blown-down automatically on shutdown to protect the machine from surging damage or to prevent gas escape through the compressor seals. An example step of manual depressurization/venting for maintenance occurs to shutdown, isolate, or take a particular segment of a process plant out of service for maintenance purposes; which typically involves venting gas inventories of the system to the flare. In this example, operators open a manual isolation valve to depressurize the content of the system until minimum pressure possible is attained. Subsequently, the inventory remaining is removed using higher pressure nitrogen or steam as purge gas.

Figure 3A:
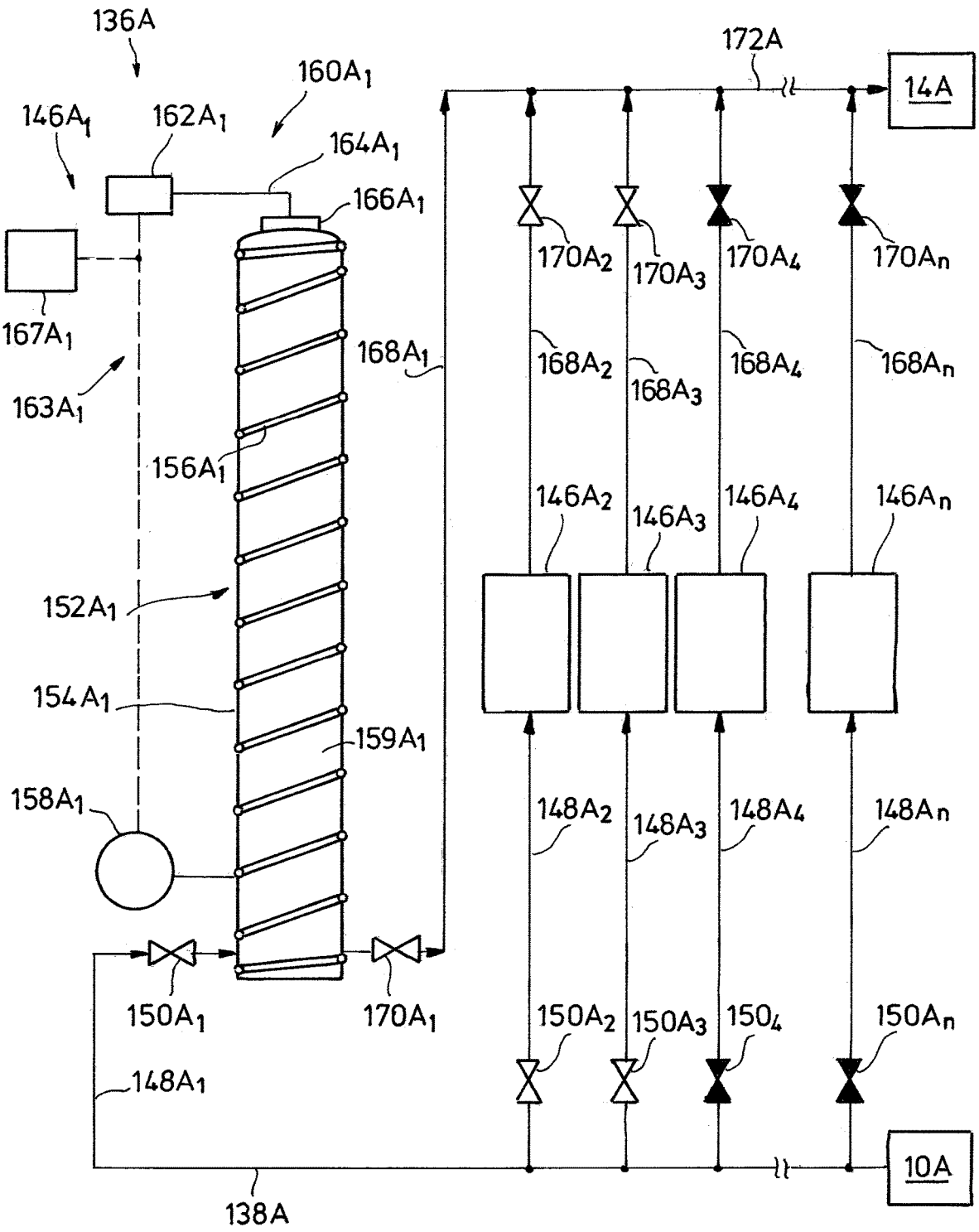
FIG. 3A is a side partial sectional view of an example of a gas storage system receiving gas.
Figure 3B:
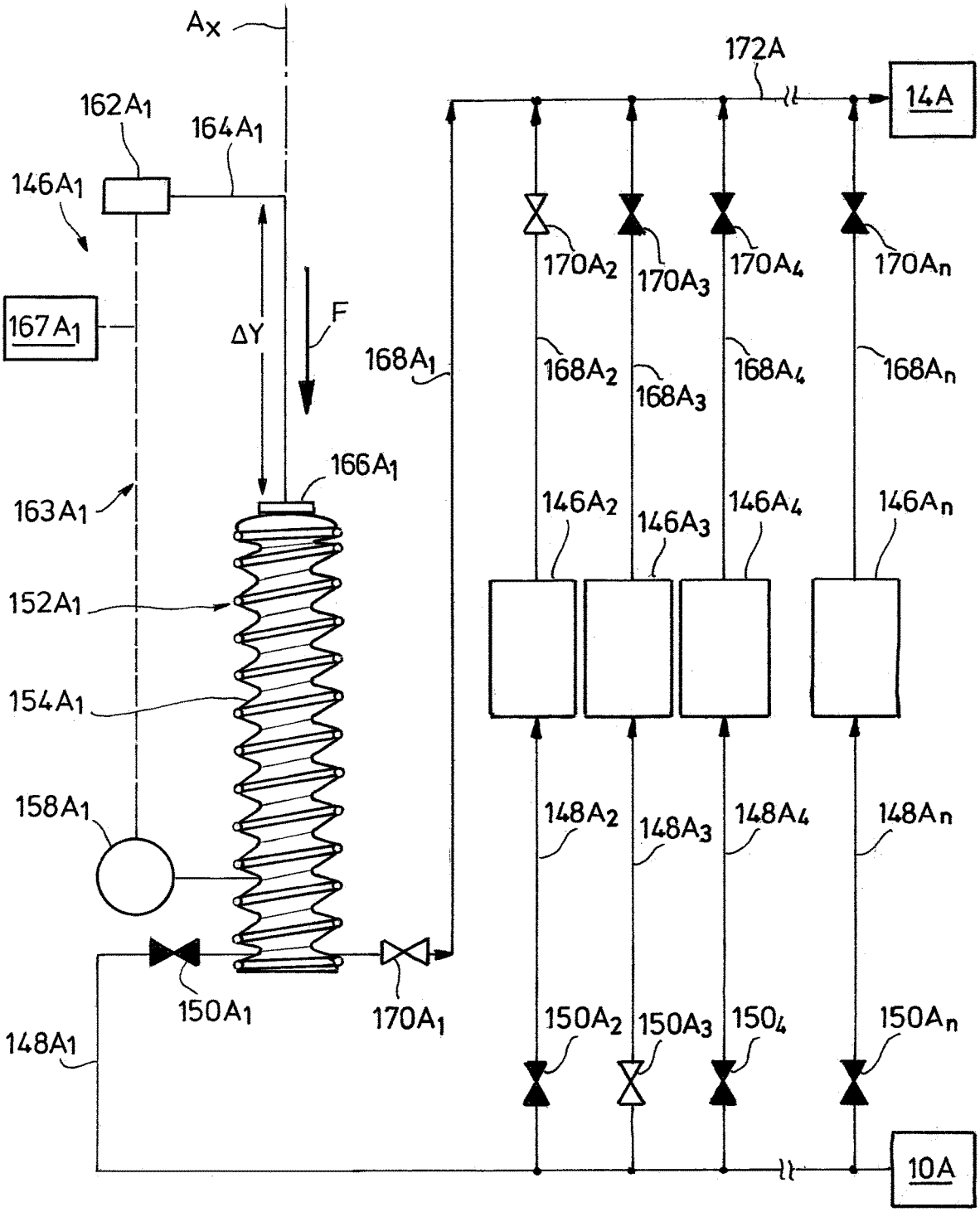
FIG. 3B is a side partial sectional view of an example of discharging gas from the gas storage system of FIG. 3A.

Referring now to FIGS. 3A and 3B, an example of a gas storage system 136A is schematically illustrated in a side partial sectional view. In the example shown gas storage system 136A includes flare gas storage units 146$A_{1-n}$, flare gas in line 138A is supplied to the storage units 146$A_{1-n}$ through leads 148$A_{1-n}$. Inlet valves 150$A_{1-n}$ are in each of the leads 148$A_{1-n}$ that provide selective control of flare gas to the storage units 146$A_{1-n}$. In an embodiment, components and details for each of the units 146$A_{1-n}$ are substantially the same; for the sake of brevity only details of unit 146$A_1$ are shown and for the purposes of discussion herein components and details of unit 146$A_1$ as disclosed are considered to be the same as each of units 146$A_{2-n}$. As shown vessel 152$A_1$ has an outer shell 154$A_1$ with a spring 156$A_1$ disposed within that provides structural support for the outer shell 154$A_1$. Shell 154$A_1$ of this example is substantially impermeable by the flare gas, are flexible, and not self-supporting. Example materials for shell 154$A_1$ includes woven fabric, composites, laminated sheets, elastomers, metals, metal alloys, and combinations. Further in this example material making up the shell 154$A_1$ maintains its integrity and operates as a barrier to fluid flow when exposed to pressures at least as great as a maximum expected pressure of the flare gas. Optionally, the material making up the shell 154$A_1$ has a design pressure at around a design pressure of other equipment for use in handling flare gas; which is determinable by one skilled in the art.

Spring 156$A_1$ of FIG. 3A is a helical member with multiple coils and having an outer diameter that defines an inner diameter of the vessel 152$A_1$. In embodiments, the spring 156$A_1$ is made up of multiple helical members stacked on one another, or alternatively formed from telescoping tubulars that insert inside the shell 154$A_1$ and having outer diameters that are in close contact with an inner diameter of the shell 154$A_1$. Further included with the example unit 146$A_1$ is a sensor 158$A_1$ shown in communication with a chamber 159$A_1$ formed within the shell 154$A_1$, in the embodiment shown pressure, temperature, and other conditions inside the shell $A_1$ is obtainable with sensor 158$A_1$. Pressure system 160$A_1$ is shown included with unit 146$A_1$ that includes an actuator 162$A_1$ shown in communication with sensor 158$A_1$ via communication means 163$A_1$, which in examples is one or more of wireless, electrically conducting, or fiber optic. An arm 164$_1$ is coupled with actuator 162$A_1$, and a platen 166$A_1$ is coupled with an end of each arm 164$A_1$ distal from the actuator 162$A_1$. Also connected to vessel 152$A_1$ is an outlet lead 168$A_1$ equipped with a valve 170$A_1$ for controlling flow through the outlet lead 168$A_1$. The lead 168$A_1$ terminates at a header line 172A which provides a means for transmitting flare gas back to facility 14A.

In the example of FIG. 3A valves 150$A_{1\text{-}3}$, are shown in an open configuration, and which allows flare gas from system 10A and in line 138A to flow through lines 148$A_{1\text{-}3}$, across valves 150$A_{1\text{-}3}$, and into storage units 146$A_{1\text{-}3}$. Valves 150$A_{4\text{-}n}$ are shown in a closed configuration, which isolates storage units 146$A_{4\text{-}n}$ from flare gas flowing from system 10A. Also in this example of operation is that valves 170$_{1\text{-}n}$ are all in the closed configuration, which blocks flow of flare gas from the storage system 136A to the facility 14A. In an example of operation, flare gas recovered by system 10A is being stored in the storage system 136A by selectively directing the flare gas into one or more of storage units 146$A_{1\text{-}n}$ as described above.

Referring now to FIG. 3B, valve 150$A_1$ is shown having been moved into a closed configuration that blocks flare gas within line 138A from flowing into unit 146$A_1$ or vessel 152$A_1$; valve 170$A_1$ is shown in an open configuration which allows flare gas inside vessel 152$A_1$ to flow from vessel 152$A_1$ to facility 14A via lead 168$A_1$ and line 172A. In this example, actuator 162$A_1$ is energized to extend arm 164$A_1$ from its retracted position of FIG. 3A and to an extended position to bias platen 166$A_1$ axially against vessel 152$A_1$ (as represented by force F) to collapse vessel 1521. As the material making up the vessel 152$A_1$ is not permeable by the flare gas, collapsing vessel 152$A_1$ reduces a volume of chamber 159$A_1$ and correspondingly increases pressure inside the vessel 152$A_1$ which forces flare gas from within vessel 152$A_1$ into lead 168$A_1$ where it is transmitted to facility 14A through line 172A. The flexibility of the material making up the outer shell 154$A_1$ allows the vessel 152$A_1$ to be compressed and without permanent deformation, so that when the force F is removed (i.e. the arm 164$A_1$ and 166$A_1$ platen are returned to their retracted configuration of FIG. 3A), the spring 156$A_1$ expands from its compressed state of FIG. 3B back to the relaxed or free state of FIG. 3A, and the lateral sidewalls of the vessel 152$A_1$ return to their generally linear shape of FIG. 3A thereby removing undulations in the sidewalls. When springs 156$A_{4\text{-}n}$ are in the relaxed or free state as shown in FIG. 3A and extended, vessels 152$A_{4\text{-}n}$ are also in extended configurations which results in chambers 159$A_{4\text{-}n}$ being in at a maximum or substantially maximum volume capacity for retaining flare gas within. When vessels 152$A_{1\text{-}n}$ are in their compressed configurations chambers 159$A_{4\text{-}n}$ are in a reduced volume capacity configuration, and in which a smaller volume of flare gas is within chambers 159$A_{4\text{-}n}$.

In a non-limiting example of operation, the amount that the vessel 152$A_1$ is collapsed or compressed is controlled to maintain a pressure of the flare gas inside of vessel 152$A_1$ at a designated pressure. In the example shown, vessel 152$A_1$ is compressed by an amount $\Delta Y$ and along axis $A_X$ of vessel 152$A_1$. In an example, a designated pressure is a pressure inside the vessel 152$A_1$ that is adequate for flare gas to flow through lead 168$A_1$, line 172A, and to back to facility 14A. In a non-limiting example of operation, pressure inside chamber 159$A_1$ is monitored by sensor 158$A_1$, and in response to feedback from sensor 158$A_1$, and/or control signals from controller 167$A_1$, actuator 162$A_1$ is commanded to selectively extend arm 164$A_1$ by an amount $\Delta Y$ that maintains a designated pressure inside vessel 152$A_1$. Alternatively, the magnitude of force F exerted by platen 166$A_1$ against vessel 152$A_1$ is monitored and controlled to maintain the designated pressure inside vessel 152$A_1$. Shown in the example of FIG. 3B is that valve 170$A_2$ is open (in addition to valve 170$A_1$) and valves 170$A_{3\text{-}n}$ are illustrated in the closed configuration which bars the flow of flare gas from vessels 152$A_{3\text{-}n}$ within units 146$A_{3\text{-}n}$ to the facility 14A. Further in the example of FIG. 3B is that valve 150$A_3$ is shown in an open configuration and which allows flare gas to flow into vessel 152$A_3$. Example embodiments of the arm 164$A_1$ include telescoping tubular members that are selectively configured into an extending portion by one or more of a pressurized fluid, an electromagnetic force, or a threaded member that operates similar to what is commonly referred to as a jack-screw. One optional embodiment of the arm 164$A_1$ includes a rack and pinion for exerting a force F against vessel 152$A_1$.

The present disclosure, therefore, is well adapted to carry out the objects and attain the ends and advantages mentioned, as well as others inherent. While a presently preferred embodiment of the disclosure has been given for purposes of disclosure, numerous changes exist in the details of procedures for accomplishing the desired results. In one embodiment, the vessels, valves, and associated instrumentation are all mounted onto a single skid unit. Optionally, screw type compressors are used in conjunction with or in place of the ejectors. In another alternative, gas received and stored by gas storage system 136A is not limited to flare gas from system 10 or 10A, but handles gas from any other source, including a conventional flare gas recovery system 63A. These and other similar modifications will readily suggest themselves to those skilled in the art, and are intended to be encompassed within the spirit of the present disclosure and the scope of the appended claims.

What is claimed is:

1. A processing facility comprising:

a source of flare gas;

a flare gas recovery system; and a flare gas storage system made up of flare gas storage units that each comprise, a vessel comprising, a resilient member, an outer shell made from a flexible material that is supported on the resilient member, and a pressure system that is selectively changeable between an extended configuration and a retracted configuration, and when in the extended configuration the vessel is in a compressed configuration, wherein the resilient member expands from the compressed configuration to a free configuration when the pressure system is in the retracted configuration, and wherein the vessel comprises lateral sidewalls that are undulated when in the compressed configuration, and wherein the lateral sidewalls are generally linear and without undulations when ion the free configuration.

2. The facility of claim 1, wherein the pressure system comprises an arm, a platen mounted on an end of the arm and that is in contact with an end of the vessel, and an actuator that when selectively energized the arm and platen are urged into compressive engagement with the vessel and the vessel and resilient member are reconfigured into a compressed configuration.

3. The facility of claim 1, wherein the resilient member comprises a helical spring.

4. The facility of claim 1, wherein the flexible material defines a barrier to flare gas and forms a cavity in which flare gas is stored.

5. The facility of claim 1, further comprising a pressure sensor in pressure communication with an inside of the vessel and that is in communication with the pressure system.

6. The facility of claim 5, wherein the pressure system is controlled based on pressure sensed inside the vessel.

7. The facility of claim 1, wherein the flexible material is not self-supporting.

8. A processing facility comprising:

a source of flare gas;

a flare gas recovery system; and a flare gas storage system made up of flare gas storage units that each comprise, an outer shell that comprises a flexible woven fabric material that is supported by a resilient member that is inside the outer shell, a pressure system selectively being in an extended configuration in which the outer shell is in a compressed configuration, the pressure system being selectively changeable into a retracted configuration in which the outer shell is in a free configuration, wherein the resilient member comprises a spring that is compressed when the outer shell is in the compressed configuration, and expanded when the outer shell is in the free configuration, and wherein a volume inside the outer shell when in the free configuration is greater than a volume of the outer shell when in the compressed configuration.

9. The facility of claim 8, wherein the woven fabric material is not self-supporting.

10. A processing facility comprising:

a source of flare gas, a flare gas recovery system; and a flare gas storage system made up of flare gas storage units that each comprise, an outer shell that comprises a flexible woven fabric material that is supported by a resilient member that is inside the outer shell, a pressure system selectively being in an extended configuration in which the outer shell is in a compressed configuration, the pressure system being selectively changeable into a retracted configuration in which the outer shell is in a free configuration, wherein sidewalls of the outer shell have undulations when the outer shell is in the compressed configuration and wherein the sidewalls are generally linear when the outer shell is in the free configuration.

* * * * *